US007757881B1

(12) United States Patent
Riley

(10) Patent No.: US 7,757,881 B1
(45) Date of Patent: Jul. 20, 2010

(54) WASTE BIN APPARATUS

(76) Inventor: Matthew D. Riley, 1751 Road 175, Emporia, KS (US) 66801

( * ) Notice: Subject to any disclaimer, the term of this patent is extended or adjusted under 35 U.S.C. 154(b) by 29 days.

(21) Appl. No.: 11/853,250

(22) Filed: Sep. 11, 2007

(51) Int. Cl.
*B65D 25/22* (2006.01)
*B65D 25/24* (2006.01)

(52) U.S. Cl. ..... 220/483; 220/480; 220/485; 220/647; 220/743

(58) Field of Classification Search ..... 220/483, 220/485, 795, 481, 480, 607, 647, 738, 743, 220/23.87
See application file for complete search history.

(56) References Cited

U.S. PATENT DOCUMENTS

| | | | | | |
|---|---|---|---|---|---|
| 608,304 | A | * | 8/1898 | Rigg | 220/495 |
| 983,473 | A | * | 2/1911 | Barnes | 248/154 |
| 1,284,579 | A | * | 11/1918 | Brown | 220/485 |
| 1,288,190 | A | * | 12/1918 | Ravn | 220/491 |
| 1,530,256 | A | * | 3/1925 | Garland | 220/743 |
| 2,888,179 | A | * | 5/1959 | Daggett | 220/741 |
| D216,438 | S | | 1/1970 | Gay et al. | |
| 4,250,664 | A | * | 2/1981 | Remke | 47/76 |
| 4,620,319 | A | * | 10/1986 | Sheehan et al. | 383/33 |
| 4,702,385 | A | * | 10/1987 | Shillington et al. | 220/481 |
| 4,946,118 | A | | 8/1990 | Hastings | |
| 4,957,254 | A | | 9/1990 | Hill et al. | |
| 5,139,448 | A | * | 8/1992 | Seidler | 439/876 |
| 5,407,158 | A | | 4/1995 | Baird | |
| 5,443,173 | A | * | 8/1995 | Emery et al. | 220/6 |
| 5,564,660 | A | | 10/1996 | Gyor | |
| 5,590,804 | A | * | 1/1997 | Crum et al. | 220/483 |
| 5,772,069 | A | * | 6/1998 | Price | 220/737 |
| 5,947,322 | A | * | 9/1999 | Ho | 220/477 |
| 6,082,573 | A | * | 7/2000 | Hofman et al. | 220/480 |
| 6,152,294 | A | | 11/2000 | Weinberg | |
| 6,285,544 | B1 | * | 9/2001 | Chandramohan | 361/680 |
| 6,402,104 | B1 | | 6/2002 | Smith | |
| 6,467,735 | B1 | | 10/2002 | Clinton | |
| 6,588,620 | B1 | * | 7/2003 | Thuma et al. | 220/489 |
| 6,672,480 | B1 | * | 1/2004 | Miller | 222/129 |
| 7,047,689 | B2 | * | 5/2006 | Tipping | 43/54.1 |
| 2001/0020621 | A1 | * | 9/2001 | Immerman et al. | 220/483 |
| 2002/0043535 | A1 | * | 4/2002 | Immerman | 220/483 |
| 2006/0261022 | A1 | | 11/2006 | Sampaio | |
| 2006/0284040 | A1 | | 12/2006 | Nixon et al. | |

* cited by examiner

*Primary Examiner*—Anthony Stashick
*Assistant Examiner*—Niki M Eloshway

(57) ABSTRACT

A waste receiving apparatus includes a shower stall wall. A wastebasket has a bottom wall and a perimeter wall attached to and extending upwardly from the bottom wall. The bottom wall has a plurality of apertures extending therethrough. A mounting removably receives the wastebasket and attaches the wastebasket to the stall wall.

7 Claims, 7 Drawing Sheets

WASTE BIN APPARATUS

BACKGROUND OF THE INVENTION

Field of the Invention

The present invention relates to waste bin devices and more particularly pertains to a new waste bin device for mounting to a shower stall wall to receive trash from a person using a shower or bathtub adjacent to the shower stall wall.

SUMMARY OF THE INVENTION

The present invention meets the objectives presented above by generally comprising a shower stall wall. A wastebasket includes a bottom wall and a perimeter wall attached to and extending upwardly from the bottom wall. The bottom wall has a plurality of apertures extending therethrough. A mounting removably receives the wastebasket and attaches the wastebasket to the stall wall.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
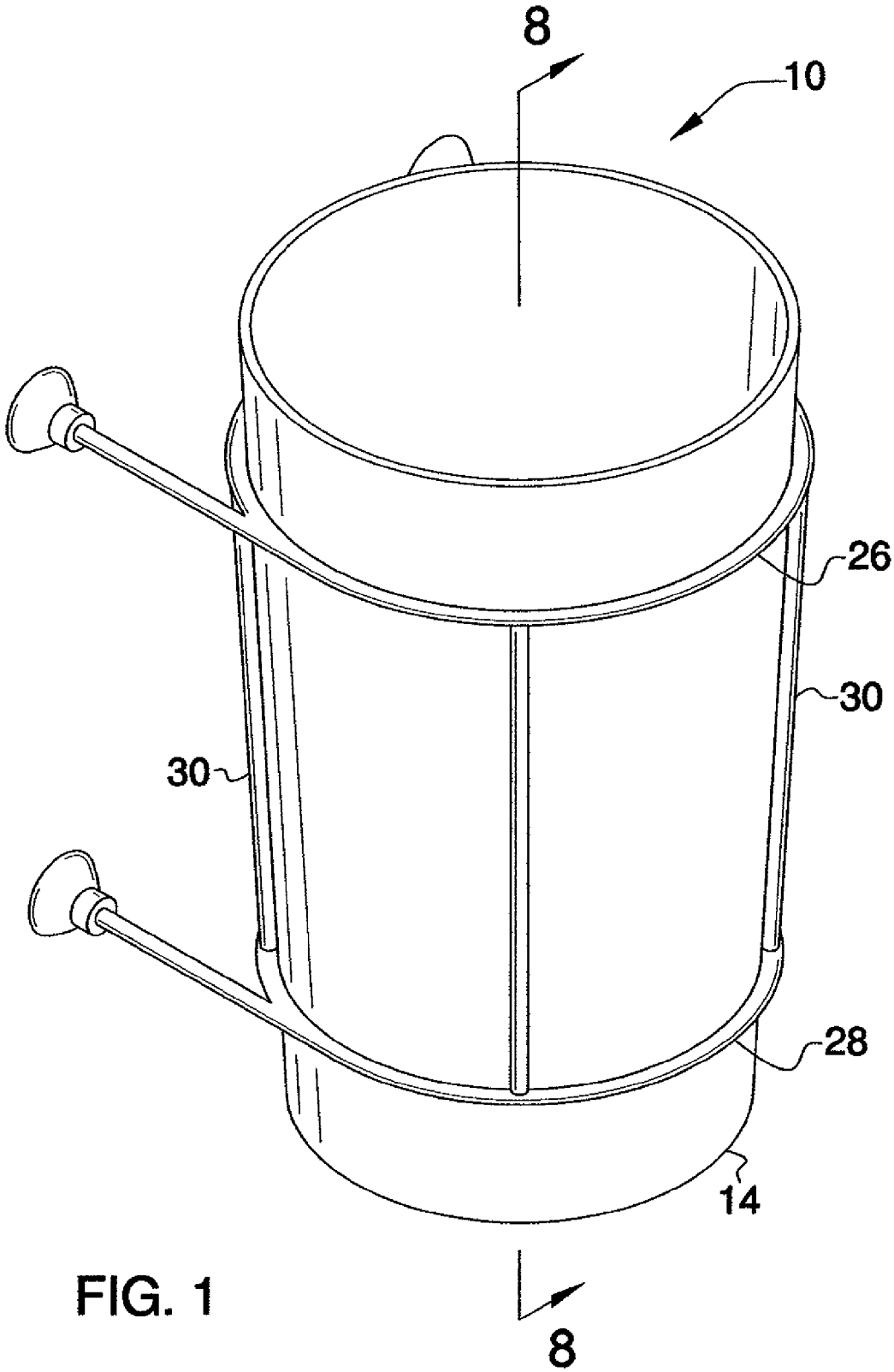
FIG. 1 is a top perspective view of a waste bin apparatus according to the present invention.
Figure 2:
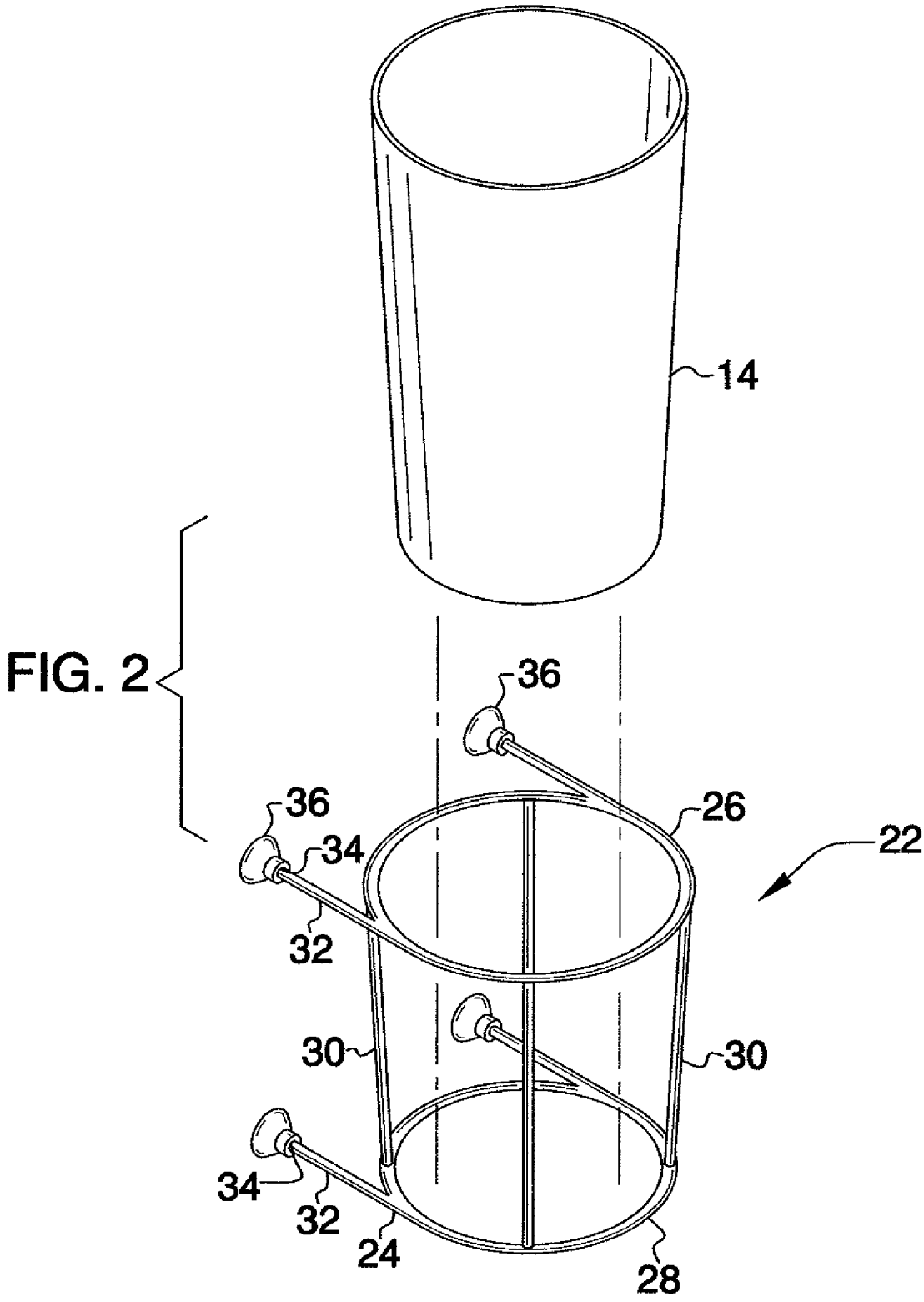
FIG. 2 is an expanded perspective view of the present invention.
Figure 3:
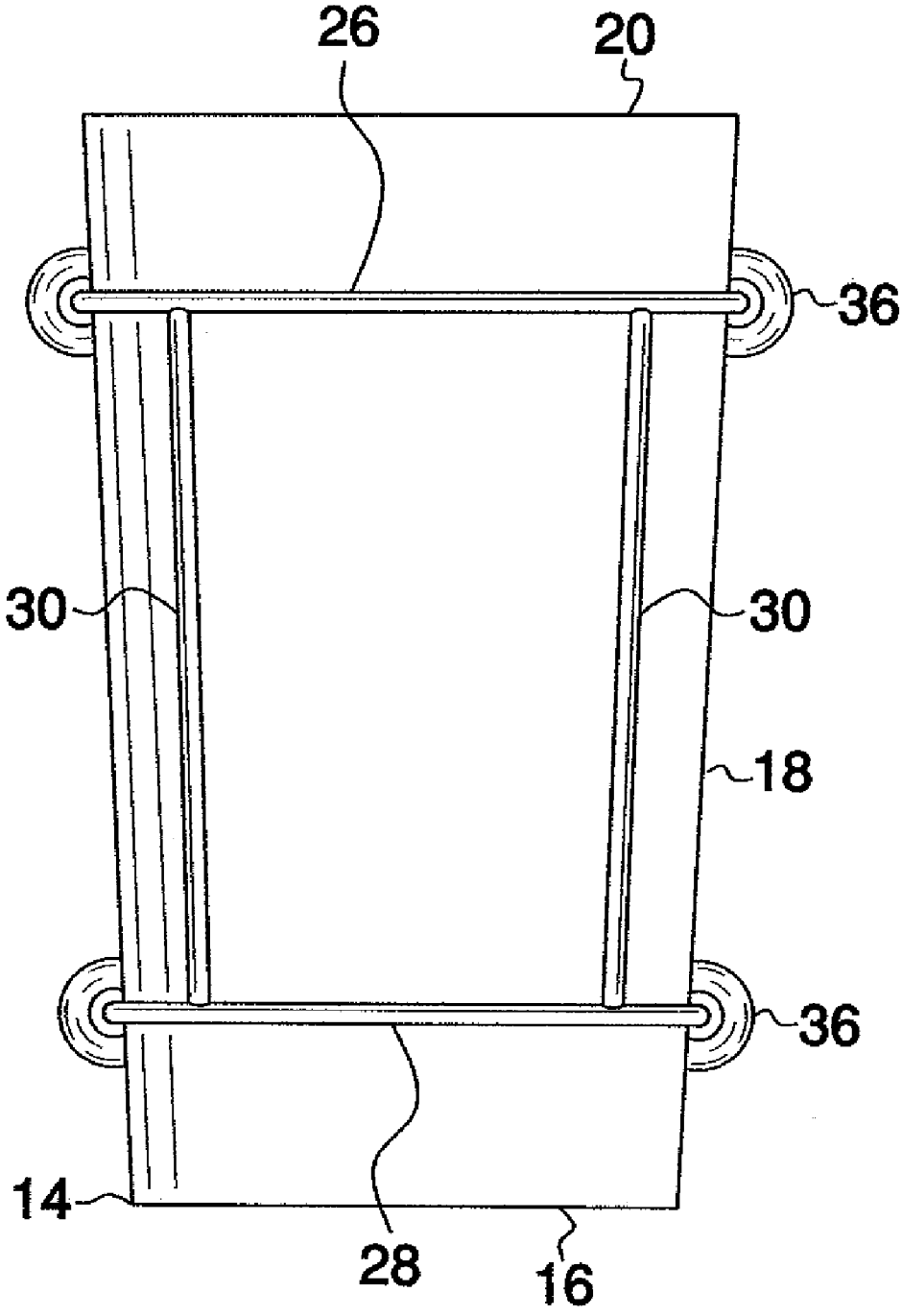
FIG. 3 is a front view of the present invention.
Figure 4:
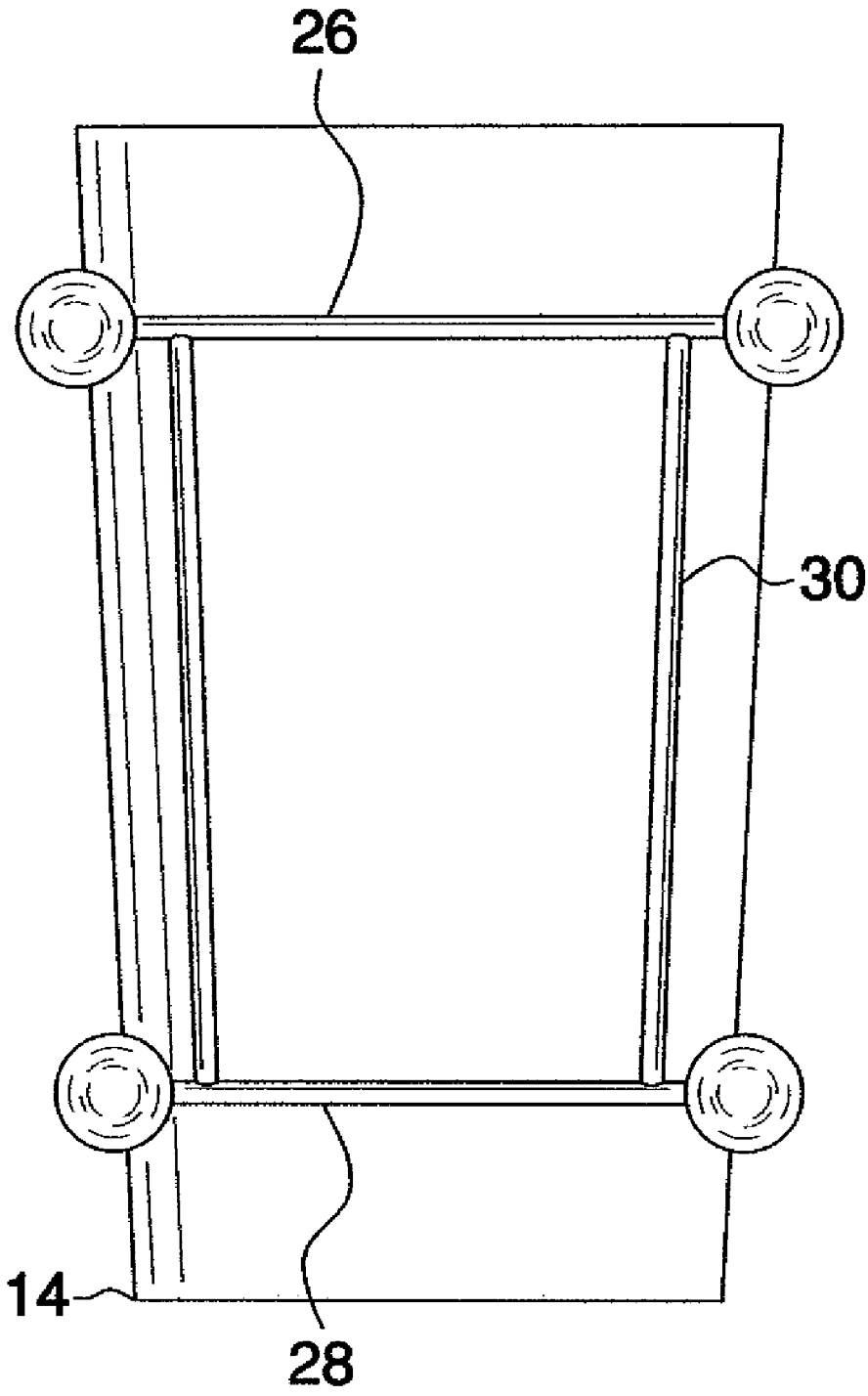
FIG. 4 is a back view of the present invention.
Figure 5:
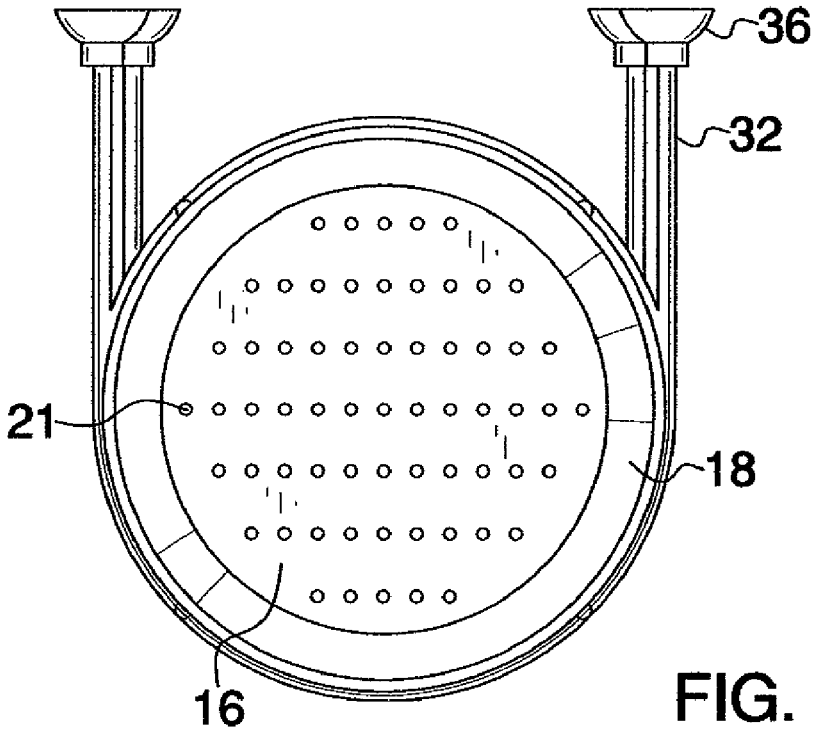
FIG. 5 is a top view of the present invention.
Figure 6:
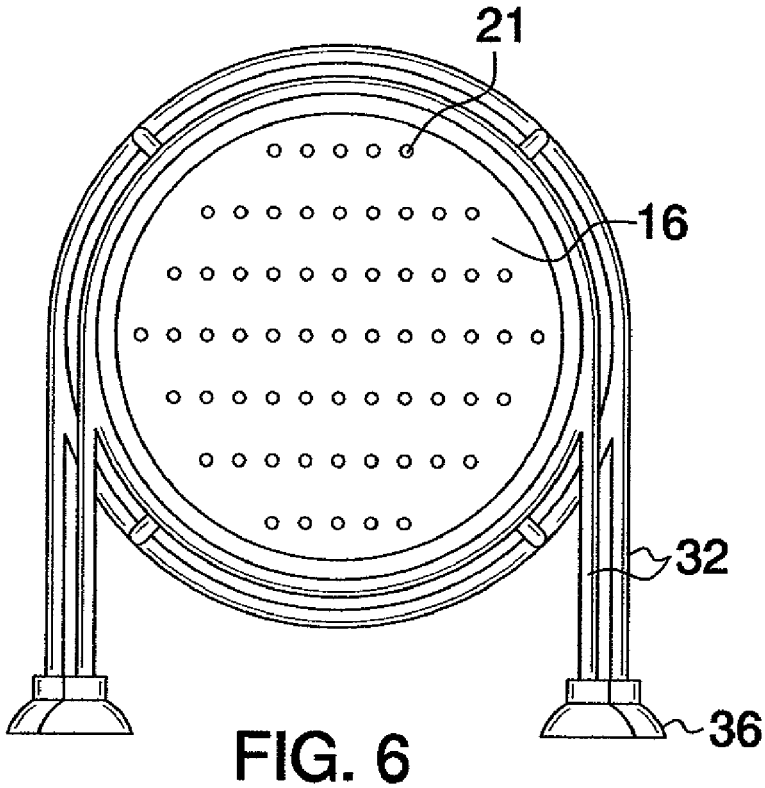
FIG. 6 is a bottom view of the present invention.
Figure 7:
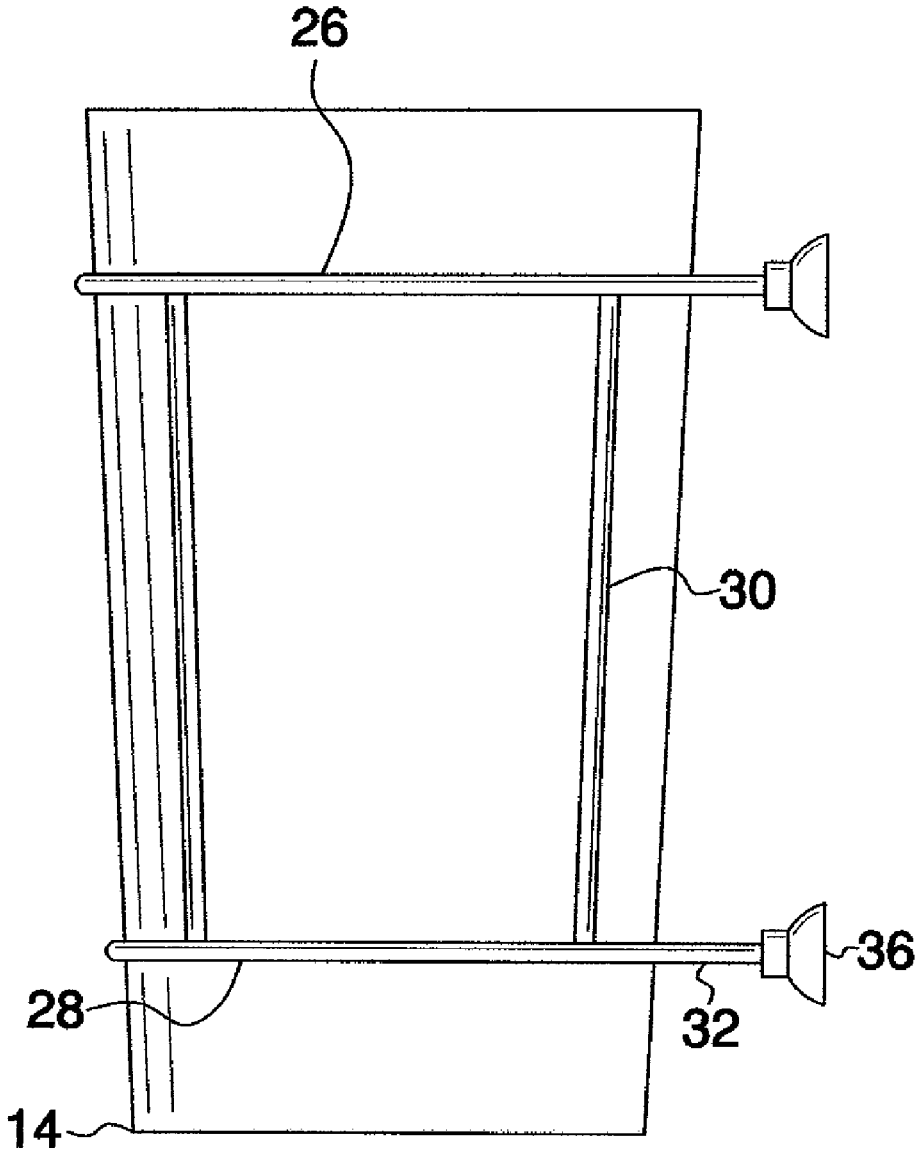
FIG. 7 is a side view of the present invention.
Figure 8:
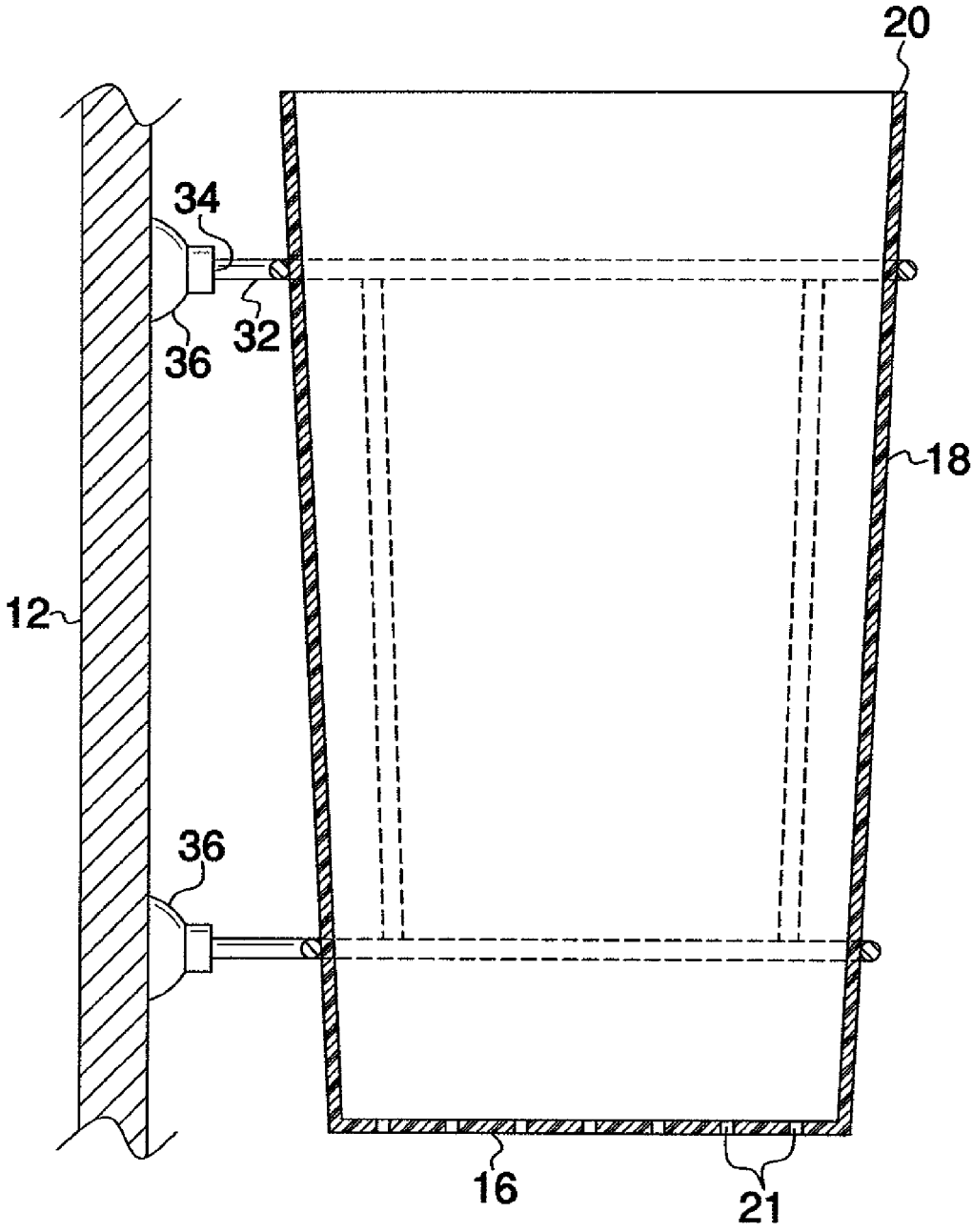
FIG. 8 is a cross-sectional view taken along line 8-8 of FIG. 1 of the present invention.

With reference now to the drawings, and in particular to FIGS. 1 through 8 thereof, a new waste bin device embodying the principles and concepts of the present invention and generally designated by the reference numeral 10 will be described.

As best illustrated in FIGS. 1 through 8, the waste bin apparatus 10 generally comprises a shower stall wall 12. The shower stall wall 12 is conventional and may be a single piece type stall comprised of a plastic or fiberglass material, or the shower stall wall 12 may be comprised of a plurality of tiles. The show stall wall 12 may be positioned adjacent to a bathtub, not shown.

A wastebasket 14 includes a bottom wall 16 and a perimeter wall 18 that is attached to and extends upwardly from the bottom wall 16. The perimeter wall 18 tapers outwardly from the bottom wall 16 to an upper edge 20 of the perimeter wall 18. The bottom wall 16 has a circular shape. The perimeter wall 18 has an inverted frusta-conical shape. The bottom wall 16 has a plurality of apertures 21 extending therethrough. The perimeter wall 18 has a height between 6 inches and 12 inches and the bottom wall 16 has a diameter between 4 inches and 8 inches.

A mounting 22 removably receives the wastebasket 14 and attaches the wastebasket 14 to the stall wall 12. The mounting 22 includes a frame 24 that has a shape to receive the wastebasket 14. The frame 24 comprises a pair of loops 26, 28 and a plurality of rods 30 attached to and extending between the loops 26, 28. The loops 26, 28 are vertically spaced from each other and are axially aligned with each other so that a line extending through each axis of the loops 26, 28 is oriented parallel to planes of each of the loops 26, 28. An upper one of the loops 26 has a smaller diameter than a diameter of the upper edge 20 of the perimeter wall 18. A plurality of posts 32 is attached to the frame 24. The posts 32 extend away from the frame 24 in a same direction with respect to each other. Each of the posts 32 has a terminal end 34. The terminal ends 34 lie in a same plane with respect to each other and this plane is oriented perpendicular to planes of the loops 26, 28. The plurality of posts 32 comprises four posts. Two of the posts 32 extend away from one of the loops 26 and two of the posts 32 extend away form the other one of the loops 28.

A plurality of suction cups 36 is provided. Each of the terminal ends 34 has one of the suction cups 36 attached thereto. The suction cups 36 are removably attached to the stall wall 12.

In use, the frame 24 is attached to the stall wall 12 and the wastebasket 14 positioned within the frame 24. The wastebasket 14 may then be used while a person is using the shower. The wastebasket 18 receives soap wrappers, empty shampoo containers, used razors and other such items. The apparatus 10 may be used, in particular, in hotel showers where sample sized toiletries are often used.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A rubbish receiving system comprising in combination:

a shower stall wall;

a wastebasket including a bottom wall and a perimeter wall being attached to and extending upwardly from said bottom wall, said bottom wall having a plurality of apertures extending therethrough;

a mounting removably receiving said wastebasket and attaching said wastebasket to said stall wall, said mounting including;

a frame having a shape to receive the wastebasket, said frame comprising a pair of loops and a plurality of rods being attached to and extending between said loops, said loops being vertically spaced from each other and being axially aligned with each other;

a plurality of posts being attached to said frame, said posts extending away from said frame in a same direction with respect to each other, each of said posts having a terminal end; and a plurality of suction cups, each of said terminal ends having one of said suction cups attached thereto, each of said suction cups being removably attached to the stall wall.

2. The system according to claim 1, wherein said perimeter wall tapers outwardly from said bottom wall to an upper edge of said perimeter wall.

3. The system according to claim 2, wherein said bottom wall has a circular shape and said perimeter wall has an inverted frusto-conical shape.

4. The system according to claim 1, wherein said terminal ends lie in a same plane with respect to each other, said plane of said terminal ends being oriented perpendicular to planes of said loop.

5. The system according to claim 4, wherein said perimeter wall tapers outwardly from said bottom wall to an upper edge of said perimeter wall.

6. The system according to claim 5, wherein said bottom wall has a circular shape and said perimeter wall has an inverted frusto-conical shape.

7. A rubbish receiving system comprising in combination:

a shower stall wall;

a wastebasket including a bottom wall and a perimeter wall being attached to and extending upwardly from said bottom wall, said perimeter wall tapering outwardly from said bottom wall to an upper edge of said perimeter wall, said bottom wall having a circular shape, said perimeter wall having an inverted frusto-conical shape, said bottom wall having a plurality of apertures extending therethrough, said perimeter wall having a height between 6 inches and 12 inches, said bottom wall having a diameter between 4 inches and 8 inches;

a mounting removably receiving said wastebasket and attaching said wastebasket to said stall wall, said mounting including;

a frame having a shape to receive the wastebasket, said frame comprising a pair of loops and a plurality of rods being attached to and extending between said loops, said loops being vertically spaced from each other and being axially aligned with each other, an upper one of said loops having a smaller diameter than a diameter of said upper edge of said perimeter wall;

a plurality of posts being attached to said frame, said posts extending away from said frame in a same direction with respect to each other, each of said posts having a terminal end, said terminal ends lying in a same plane with respect to each other, said plane of said terminal ends being oriented perpendicular to planes of said loops; and a plurality of suction cups, each of said terminal ends having one of said suction cups attached thereto, each of said suction cups being removably attached to the stall wall.

* * * * *